United States Patent [19]

Whitehurst

[11] 4,316,778

[45] Feb. 23, 1982

[54] METHOD FOR THE MANUFACTURE OF RECORDING SUBSTRATES FOR CAPACITANCE ELECTRONIC DISCS

[75] Inventor: Marshal L. Whitehurst, Indianapolis, Ind.

[73] Assignee: RCA Corporation, New York, N.Y.

[21] Appl. No.: 190,276

[22] Filed: Sep. 24, 1980

[51] Int. Cl.[3] ..... C25D 1/10; C25D 3/38

[52] U.S. Cl. ..... 204/5; 204/52 R; 204/DIG. 2

[58] Field of Search ..... 204/5, 52 R, DIG. 2

[56] References Cited

U.S. PATENT DOCUMENTS

| | | | |
|---|---|---|---|
| 2,424,887 | 7/1947 | Henricks | 204/52 R |
| 2,707,166 | 4/1955 | Brown | 204/52 R |
| 3,267,010 | 8/1966 | Creutz | 204/52 R |
| 3,996,114 | 12/1976 | Ehrsam | 204/DIG. 2 |
| 4,038,161 | 7/1977 | Eckles | 204/52 R |
| 4,134,803 | 1/1979 | Eckles | 204/52 R |

OTHER PUBLICATIONS

Udylite Technical Bulletin "Operation of the Udylite Bright Acid Copper Plating Process UBAC No. 1."

Encyclopedia of Chemical Technology, Kirk-Othmer, Second Edition 1969, vol. 19, pp. 507, 564-566, 578, 579.

*Primary Examiner*—T. M. Tufariello

*Attorney, Agent, or Firm*—Birgit E. Morris; Edward J. Sites

[57] ABSTRACT

Amphoteric fluorocarbon surfactants when added to acid copper plating baths which contain brighteners will substantially reduce or eliminate occluded hydrogen in the deposited copper without adversely affecting the properties of the copper and in particular the brightness of the copper.

4 Claims, No Drawings

METHOD FOR THE MANUFACTURE OF RECORDING SUBSTRATES FOR CAPACITANCE ELECTRONIC DISCS

This invention relates to an improved method for the manufacture of bright copper recording substrates for use in the production of capacitance electronic discs. More particularly, this invention is concerned with improvements in the electroplating of the copper so as to form substrates which are substantially free of voids.

BACKGROUND OF THE INVENTION

Capacitance electronic discs are a recently developed form of molded information storage media.

It was disclosed in U.S. Pat. No. 4,044,379 issued to Jerome Bart Halter entitled, "METHOD AND APPARATUS FOR ELECTROMECHANICAL RECORDING OF SHORT WAVELENGTH MODULATION IN A METAL MASTER", that satisfactory recordings for capacitance electronic discs can be made by electromechanically cutting the recording into a metal substrate. More particularly, it was disclosed in the Halter patent that the preferred substrate for recording of information for capacitance electronic discs is electrodeposited copper on an aluminum support.

In order to obtain the optimum properties in the recorded disc, it has been found that the copper should be electrodeposited in a bright state. Electrodeposited bright copper is distinguishable from conventional electrodeposited copper in that bright copper as deposited forms a bright, lustrous, almost mirror-like layer which is further characterized as being smoother, harder, and having an extremely small grain size as compared to conventional electrodeposited copper.

Bright electrodeposited copper is obtained by adding certain additives to conventional acid copper deposition baths which cause the copper to be deposited in the bright state. Various additives have been suggested in the prior art such as in U.S. Pat. No. 2,424,887 issued to Henricks entitled, "METHOD AND ELECTROLYTE FOR ELECTRODEPOSITION OF METAL"; U.S. Pat. No. 2,707,166 issued to Brown entitled, "ELECTRODEPOSITION OF COPPER FROM ACID BATH", and U.S. Pat. No. 3,267,010 issued to Creutz et al. entitled, "ELECTRODEPOSITION OF COPPER FROM ACIDIC BATHS".

There are likewise a variety of commercial products sold as brighteners for use in the electroplating of copper. One such product which is widely used is known as UBAC #1 and is sold by the Oxy Metal Industries Corporation, Detroit, Michigan.

The brighteners are very effective in promoting the deposition of the copper in bright lustrous layer. The resulting bright copper plating obtained with the brightener additives, particularly those disclosed in U.S. Pat. No. 3,267,010 referred to above and with commercial products such as UBAC #1, have been found to be satisfactory for most applications.

It has been found, however, that electrodeposited bright copper deposited from the bright acid copper bath disclosed in the prior art is not completely satisfactory for recording substrates for capacitance electronic discs. It has been found that using the bath composition and methods of deposition disclosed in the prior art, that the deposited copper often has internal voids which interfere with the recording of the substrates.

The plating baths which are employed for the electrodeposition of bright copper have a somewhat less than 100% current efficiency with regard to plating of the copper from the bath. Typically the baths have an efficiency of about 96% to 98%. The inherent inefficiencies in the utilization of the current for plating results in hydrogen gas being liberated at the cathode. While some of the hydrogen escapes to the atmosphere, it has been found that a portion of the hydrogen becomes occluded in the deposited copper and causes the formation of small voids in the plated layer of copper. The voids formed by the hydrogen gas bubbles are relatively small, generally being at most a few microns in size. The occluded hydrogen and the resulting voids in the deposited layer of copper are, however, especially troublesome in the substrates used for the recording of the information for the capacitive electronic discs. The voids can result in major defects in the final molded capacitance electronic disc. Because of the small size of the signal elements and the closeness of the signal tracks on the surface of the capacitance electronic disc, voids of only a few microns in width can extend over the width of several signal tracks causing a distortion of the recorded signal element. A further problem is that the voids can often result in tracking problems of the playback stylus causing the stylus to lock on a given signal track or, in the alternative, to skip signal tracks as a result of the stylus being caught in the voids.

In order to reduce the effect of the generated hydrogen on the final deposited copper metal, attempts have been made to decrease the surface tension of the plating bath by adding various types of surfactants to the plating bath, as suggested in the prior art for other plating baths such as semi-bright nickel baths. These techniques did not prove to be successful. Most of the surfactants which were evaluated were hydrocarbon based materials. The hydrocarbon based surfactants had the distinct disadvantage that when they were introduced into the plating bath, they were found to be incompatible with the acid plating baths and would either settle out or breakdown in the plating bath. Those hydrocarbon based surfactants which did not break down or did not separate from the plating bath had the further and possibly more serious deficiency that when added to the bright acid copper bath, the surfactant interfered with and in many cases completely destroyed the effectiveness of the brightener additive, and as a result the copper deposited in the form of a dull, flat, rough layer. As a result of the problems encountered in adding surfactants to bright copper baths, manufacturers of brightener compositions, as for example the manufacturer of UBAC #1 mentioned above, advise platers in their technical literature that surfactants should not be added to plating baths which contain brighteners.

It would be highly advantageous in the manufacture of bright copper recording substrates for capacitance electronic discs if a method could be provided to prevent the occlusion of hydrogen bubbles in the deposited copper layers and the resulting formation of voids without adversely affecting the brightness and other properties of the deposited copper.

SUMMARY OF THE INVENTION

It has been found that amphoteric fluorocarbon surfactants, when added to acid copper plating baths which contain brighteners, will substantially reduce or eliminate occluded hydrogen in the deposited copper without adversely affecting the properties of the copper and, in particular, the brightness of the deposited copper.

DETAILED DESCRIPTION OF THE INVENTION

The initial step in the preparation of the recording substrates for use in the recording of capacitance electronic discs is the preparation of the support on which the copper is to be deposited. The preferred support has been found to be aluminum.

A suitable size aluminum disc support is surface-machined to provide a smooth, flat surface for plating of the copper. If the aluminum substrate has previously been employed as a support for copper, it is immersed in a concentrated nitric acid bath to remove any residual copper which might cause blistering in the subsequent processing of the aluminum support.

The aluminum support is then immersed in a desmut bath to remove surface contamination. After the desmut bath the aluminum support is then immersed in a deoxidizing bath comprised of 50% nitric acid and 50% deionized water. The aluminum support is now ready for the start of the actual plating steps.

The surface of the aluminum disc is initially given a zincate treatment. The aluminum is then given a copper strike in a copper cyanide bath of conventional formulation. The copper strike is then plated over with a second relatively thin layer of copper from a conventional acid copper bath which results in the disc having a very thin but continuous dull copper coating. The copper plated disc is polished to remove any surface defects and lightly abraded to improve the adhesion of the subsequent plating of the bright copper.

The bright acid copper bath which is used in this invention with regard to its principal components is relatively conventional in composition. The bath contains copper sulfate and sulfuric acid. The relative amounts of the copper sulfate and the sulfuric acid can be varied within relatively wide ranges and still obtain satisfactory plating. Typically, however, the copper sulfate is maintained in the bath in an amount which is about between 210 to 250 grams per liter (g/l) with the optimum results generally being obtained at about 225 g/l. The sulfuric acid is added to the bath to reduce the resistivity of the bath during electroplating. The sulfuric acid is added in an amount of about 50 g/l to 80 g/l with the optimum results being obtained with about 60 g/l. Other conventional additives such as, for example, hydrochloric acid and ferric sulfate are added in minor amounts as required.

To obtain bright copper it is essential to add a brightening agent to the bath. The amount of the brightening agent added to the bath is dependent upon the type of brightener employed and the desired degree of brightness. With brighteners of the type disclosed in U.S. Pat. No. 3,267,010 which are comprised of an organic sulfide compound having at least one sulfonic acid group, a polyether compound containing at least 6 ether oxygen atoms and which is free of alkyl chains having more than 6 carbon atoms and a phenazine dye, or with commercial products such as UBAC #1, satisfactory results are obtained when amounts of about 20 grams per liter of the brightener are added to the bath. The amount of brightener added to the bath can be adjusted as required to obtain the desired amount of brightness.

The plating baths of this invention, in addition to containing the relatively conventional materials of the type noted above, also contain an amphoteric fluorocarbon surfactant in amounts sufficient to reduce or eliminate voids in the final coating caused by occluded hydrogen. The addition of the amphoteric fluorocarbon surfactant substantially reduces the surface tension of the bath and it is believed this permits the hydrogen to be evolved from the cathode to the atmosphere rather than becoming occluded in the deposited layer of copper.

The amphoteric fluorocarbon surfactants as a class have a unique combination of properties which makes them useful in the method of this invention. The bright acid copper plating baths described herein are strongly acid and accordingly, compatibility of the surfactant with the bath is the first consideration. Anionic surfactants, even anionic fluorocarbon surfactants, are not suitable in that they exhibit instability in the plating baths. Cationic and nonionic surfactants, even cathionic and nonionic fluorocarbon surfactants, were found to have a marginal to satisfactory stability in the plating baths but were also found to substantially reduce or effectively destroy the brightening properties of the brightener compounds. Among all of the types of surfactants evaluated only the amphoteric fluorocarbon surfactants were found to be both stable in the acid copper plating bath and able to reduce the occlusion of hydrogen in the deposited metal without adversely affecting the brightness and other desired properties of the deposited metal.

The amphoteric fluorocarbon surfactants are a well-known class of surfactants and may be commercially purchased from various sources. One particular commercial surfactant which has been found to be suitable for use in the present invention is referred to as Zonyl FSB which is sold by E. I. duPont de Nemours and Company (INC.).

The amount of the amphoteric fluorocarbon surfactant which is added to the electroplating bath should be an amount to significantly reduce the surface tension of the bath as compared to the bath without the surfactant. Typically the electroplating bath before the addition of the amphoteric fluorocarbon surfactant will have a surface tension of about 50 dynes per sq cm. An amount of the amphoteric fluorocarbon surfactant is added to the electroplating bath which is sufficient to reduce the surface tension of the bath to a value of about 30 dynes or less per sq cm. It has been found when an amount of an amphoteric fluorocarbon surfactant is added which reduces the surface tension to 30 dynes or less, that there is a significant reduction if not complete elimination of voids in the plating as a result of occluded hydrogen bubbles.

The plating of the bright copper onto the aluminum substrate can be conducted in the same manner as that heretofore employed in the plating of substrates without the amphoteric fluorocarbon surfactant addition.

It has been found that the addition of the amphoteric fluorocarbon surfactant to the bath significantly reduces or eliminates voids in the coating caused by the occluded hydrogen and does not have any adverse affects on the deposited copper. The brightness, hardness, ductility and other properties of the plating is identical to that obtained with electrolyte baths which do not contain an amphoteric fluorocarbon surfactant.

The following Example is given by way of illustration of the present invention and is not intended to limit the scope of the claims.

EXAMPLE

A series of aluminum substrates were prepared for use in evaluating the effect of an amphoteric fluorocarbon surfactant on copper deposited from a bright acid copper bath.

The aluminum substrates were each fine machined and thereafter inspected to make sure that there were no surface defects.

The substrates were then immersed in a concentrated nitric acid bath and thereafter rinsed with deionized water and dried.

The substrates were then immersed in a desmut bath comprised of a mixture made up of 50% nitric acid, 50% sulfuric acid to which about 120 grams per liter of Actane 70, a commercial acid additive, were added. The substrates were then rinsed with deionized water.

The substrates were then immersed in a deoxidizing bath consisting of a 50% aqueous solution of nitric acid and thereafter rinsed.

The substrates were then immersed in a zincate solution containing about 525 grams per liter of sodium hydroxide and 100 grams per liter of zinc oxide. The deposited gelatinous coating was allowed to dry for several days.

The substrates were then given a first copper strike in a copper cyanide bath containing 40 grams per liter of copper cyanide, 50 grams per liter of sodium cyanide, 4 g/l of sodium carbonate, and 20 grams per liter of Rochelle salt.

The aluminum substrates were then plated with an extremely thin layer of electrodeposited copper. The copper was deposited from an acid copper bath containing 210 grams per liter of copper sulfate and 50 grams per liter of sulfuric acid. The copper which was deposited was dull copper and was formed in a thin but continuous layer on the surface of the substrate.

The substrates were then divided into two separate groups with one group to be electroplated with bright copper in the absence of the surfactant and the other group to be plated with bright acid copper in the presence of a surfactant. The plating bath was made up of deionized water and contained 225 grams per liter of copper sulfate, 60 grams per liter of sulfuric acid, and 20 grams per liter of the commercial copper brightener UBAC #1. The surface tension of the bath was measured and found to be 55 dynes per centimeter. One group of the substrates were electroplated in the bath until a layer of copper of approximately 0.025 cm thick was formed on the surface of the substrates.

The plating bath noted above was then re-evaluated with regard to surface tension and was found still to be 55 dynes per centimeter. An amount of a commercially available amphoteric fluorocarbon surfactant, Zonyl FSB, was gradually added to the bath until the surface tension was lowered to 30 dynes per square centimeter. The amount of surfactant which was added was about 0.025 gram per liter. The remainder of the substrates were then plated in this bath until approximately 0.025 cm of copper was deposited on the substrates.

The substrates which were plated in the absence of the surfactant and those plated in the bath containing the surfactant were both surface-machined in the conventional manner. The surfaces of the substrates were then evaluated microscopically to determine defects. Those substrates plated in the absence of the surfactant were found to have a considerable number of small voids formed by occluded hyrogen bubbles in the deposited copper. The substrates which were plated in the bath containing the amphoteric fluorocarbon surfactant, however, were found to be free or substantially free of any surface void and on recording were found to be superior substrates for the manufacture of capacitance electronic discs.

What is claimed is:

1. In the method for the manufacture of a recording substrate for a capacitance electronic disc in which bright acid copper is electrodeposited from a bath which is comprised of copper sulfate, sulfuric acid, and a brightener the improvement which comprises adding an amphoteric fluorocarbon surfactant to the bath in an amount sufficient to reduce or eliminate occluded hydrogen bubbles in the deposited layer of copper.

2. The method according to claim 1 wherein the amphoteric fluorocarbon surfactant is added in an amount sufficient to reduce the surface tension of the bath to at least about 30 dynes per sq cm.

3. The method according to claim 2 wherein the brightener is comprised of organic sulfide compounds having at least one sulfonic acid group, a polyether compound containing at least 6 ether oxygen atoms and which is free of alkyl chains having more than 6 carbon atoms and a phenazine dye.

4. An aqueous bath for electroplating bright acid copper comprised of about 210 to 250 grams per liter of copper sulfate, about 50 to 80 grams per liter of sulfuric acid, a copper brightener in an amount effective to promote the bright deposition of the copper from the bath, and an amount of an amphoteric fluorocarbon surfactant sufficient to lower the surface tension of the bath to at least about 30 dynes per square centimeter.

* * * * *